US008814466B2

(12) United States Patent
Buschmann et al.

(10) Patent No.: US 8,814,466 B2
(45) Date of Patent: Aug. 26, 2014

(54) CHARGING VEHICLE

(75) Inventors: Martin Buschmann, Neustadt (DE); Steffen Fickeisen, Bad Durkheim (DE); Tobias Elser, Heidelberg (DE); Helmut Kessler, Kaiserslautern (DE)

(73) Assignee: Joseph Vogele AG, Ludwigshafen/Rhein (DE)

( * ) Notice: Subject to any disclaimer, the term of this patent is extended or adjusted under 35 U.S.C. 154(b) by 129 days.

(21) Appl. No.: 13/640,689

(22) PCT Filed: Apr. 13, 2011

(86) PCT No.: PCT/EP2011/001878

§ 371 (c)(1),
(2), (4) Date: Jan. 29, 2013

(87) PCT Pub. No.: WO2011/128092

PCT Pub. Date: Oct. 20, 2011

(65) Prior Publication Data

US 2013/0121765 A1 May 16, 2013

(30) Foreign Application Priority Data

Apr. 16, 2010 (EP) ..... 10004065

(51) Int. Cl.
*E01C 23/14* (2006.01)
*E01C 19/12* (2006.01)

(52) U.S. Cl.
USPC ..... 404/95; 404/108; 404/109; 198/300

(58) Field of Classification Search
USPC ..... 404/101, 108, 109, 110, 95; 198/300, 198/312
See application file for complete search history.

(56) References Cited

U.S. PATENT DOCUMENTS

| | | | | | |
|---|---|---|---|---|---|
| 1,841,525 | A * | 1/1932 | Evensen | 414/523 |
| 2,428,513 | A * | 10/1947 | Cooley | 198/300 |
| 2,456,237 | A * | 12/1948 | Acton | 56/15.9 |
| 3,540,359 | A * | 11/1970 | Swisher, Jr. et al. | 404/110 |
| 3,863,783 | A * | 2/1975 | Spellman, Jr. | 414/523 |
| 4,526,493 | A * | 7/1985 | Hall et al. | 404/105 |
| 4,812,076 | A * | 3/1989 | Yant | 404/108 |
| 4,978,068 | A * | 12/1990 | Eldridge | 239/129 |
| 5,533,829 | A * | 7/1996 | Campbell | 404/81 |
| 5,899,630 | A * | 5/1999 | Brock | 404/79 |
| 6,332,736 | B1 * | 12/2001 | Cape et al. | 404/75 |
| 6,481,924 | B1 * | 11/2002 | Smolders et al. | 404/105 |
| 6,604,620 | B2 * | 8/2003 | Dennis | 198/312 |
| 7,300,225 | B2 * | 11/2007 | Musil | 404/79 |
| 7,523,995 | B2 * | 4/2009 | Rio et al. | 299/39.6 |

FOREIGN PATENT DOCUMENTS

| | | |
|---|---|---|
| DE | 3524463 A1 | 1/1987 |
| DE | 29706918 U1 | 2/1998 |
| FR | 2611766 A1 | 9/1988 |

OTHER PUBLICATIONS

International Preliminary Report on Patentability mailed Oct. 26, 2012, which issued in corresponding International Application No. PCT/EP2011/001878.

* cited by examiner

*Primary Examiner* — Gary Hartmann
(74) *Attorney, Agent, or Firm* — Fish & Richardson, P.C.

(57) ABSTRACT

The invention relates to a charging vehicle (1) for conveying road-surfacing mix to a road-finishing machine, wherein the charging vehicle (1) comprises a conveyor assembly (5) and a machine drive (6). The invention is characterized in that the machine drive (6) is arranged on the charging vehicle (1) laterally offset with respect to the conveyor assembly device (5).

7 Claims, 2 Drawing Sheets

CHARGING VEHICLE

CROSS REFERENCE TO PRIOR APPLICATIONS

This is a U.S. National Phase application under 35 U.S.C. §371 of International Patent Application No. PCT/EP2011/001878, filed Apr. 13, 2011, and claims the priority of European Patent Application No. 10004065.8, filed Apr. 16, 2010 both of which are incorporated by reference herein in their entirety. The International Application published in German on Oct. 20, 2011 as WO 2011/128092 under PCT Article 21(2).

FIELD OF THE INVENTION

The present invention relates to a charging vehicle for conveying a road surfacing mix to a road finishing machine.

Such charging vehicles are used for storing a road-surfacing mix, for example concrete or a bituminous road-surfacing mix, such as asphalt, and transporting it to a road finishing machine. Here, the charging vehicle is usually automotive and moves in the working direction in front of the road finishing machine. Generic charging vehicles can be taken, for example, from EP 2 110 341 A1, DE 299 19 242 U1, DE 298 11 212 U1, DE 295 17 342 U1, DE 290 20 945 U1, or DE 196 34 013 A1.

To be automotive and capable of moving mobile working units, such as the conveyor assembly, a charging vehicle comprises a machine drive, often a diesel engine. For symmetry and stability reasons, the machine drive is in all conventional charging vehicles located centrically on the charging vehicle and underneath the conveyor assembly for the road-surfacing mix. However, conventional charging vehicles are often difficult to maintain.

It is the object of the present invention to improve a charging vehicle such that it can be better maintained and cleaned by means that are constructively as simple as possible.

SUMMARY OF THE INVENTION

This object is achieved by a charging vehicle according to the present invention.

In the charging vehicle according to the invention, the machine drive is no longer disposed centrically underneath the conveyor assembly but laterally offset with respect to the conveyor assembly. Compared to the conventional design, this permits a clearly improved accessibility to the machine drive for maintenance and cleaning operations, so that these works are essentially facilitated. Simultaneously, the time required for maintenance and cleaning operations is reduced, so that the charging vehicle can be operated more efficiently and inexpensively.

It is particularly advantageous for the machine drive to be laterally disposed next to the conveyor assembly. In this manner, the machine drive is not superposed by the conveyor assembly and is in particular freely accessible from above—possibly after a cover for protecting the machine drive has been removed.

Preferably, the machine drive can be accessed from several sides, for example from above and from the side of the charging vehicle, or else from the back. This permits to quickly reach, maintain and clean various components of the machine drive without any major efforts. The replacement of individual components of the machine drive is also facilitated.

It is suitable for the bottom side of the conveyor assembly to also be, at least in sections, accessible for maintenance and/or cleaning operations. This is permitted in the inventive charging vehicle by the machine drive no longer occupying the space underneath the conveyor assembly.

It is conceivable to have a storage space in the space under the conveyor assembly that has been liberated by dislocating the machine drive. In this storage space, for example, equipment, a water tank, an oil can, or spare parts for the charging vehicle can be provided, for example a spare belt for a conveyor assembly designed as a conveyor belt, or spare parts for the machine drive.

The charging vehicle becomes particularly maintenance-free, with a simultaneously high conveying capacity, if the conveyor assembly is designed as a conveyor belt.

In an advantageous variant of the invention, the exhaust pipe is guided from the machine drive at least in sections along the conveyor assembly. In this manner, the waste heat of the machine drive can be used for heating the conveyor assembly and thus for heating the road-surfacing mix transported on the conveyor assembly. The period during which the road-surfacing mix can be laid is thus extended.

It is in particular advantageous for a section of the exhaust pipe to be guided from the machine drive underneath and along a section of the conveyor assembly. Thereby, the conveyor assembly can be heated without the exhaust pipe restricting or interfering with the stream of transported road-surfacing mix.

If the conveyor assembly comprises a conveyor belt, a section of the exhaust pipe can be guided from the machine room, for example between an upper run and a lower run of the conveyor belt. Since the road-surfacing mix is transported on the upper run, the heating effect of the exhaust pipe on the road-surfacing mix is particularly efficient. Simultaneously, the exhaust pipe neither interferes with the operation nor with the cleaning, for example of the bottom side of the lower run of the conveyor belt.

For stability reasons, it can be advantageous for the conveyor assembly to be disposed eccentrically on the charging vehicle according to the invention. While the one side of the charging vehicle is loaded by the conveyor assembly and the road-surfacing mix transported on it, the other side of the charging vehicle is loaded by the machine drive and, for example, by a control cabin.

Below, an advantageous embodiment of the invention will be illustrated more in detail with reference to a drawing. The drawings show in detail:

Figure 1:
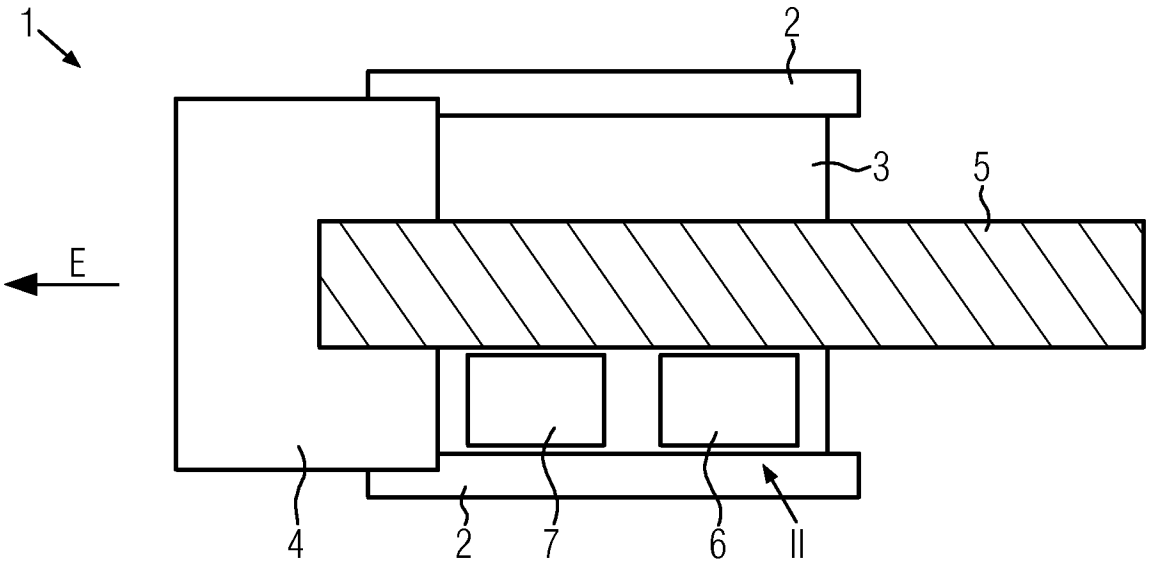
FIG. 1 a plan view onto a charging vehicle according to the invention.

Equal components are provided with equal reference numerals in the figures.

DETAILED DESCRIPTION OF THE INVENTION

FIG. 1 shows a plan view onto a charging vehicle 1 according to the invention for conveying a road-surfacing mix (for example asphalt) to a road finishing machine. The charging vehicle 1 is automotive and to this end has a running gear 2, in the present embodiment a crawler running gear. By means of the running gear 2, the charging vehicle 1 can in particular move in the direction of laying which is designated with E in FIG. 1.

A material bunker 4 is provided at the front end of the vehicle body 3 of the charging vehicle 1, seen in the direction of laying E. A road-surfacing mix can be stored in this material bunker 4.

The road-surfacing mix is transported from the material bunker 4 to the rear end of the charging vehicle 1 and beyond this rear end by means of a conveyor assembly 5. In the represented embodiment, a conveyor belt is provided as conveyor assembly 5. This conveyor belt 5 can rise towards the rear. It is conceivable to be able to change the inclination and/or the orientation of the conveyor belt 5.

A machine drive 6, for example a diesel engine, is provided for driving the running gear 2 and the conveyor assembly 5. One can see in the plan view that the machine drive 6 is disposed laterally next to the conveyor assembly 5 and thus eccentrically on the charging vehicle 1.

Furthermore, the charging vehicle 1 includes a control cabin 7. The charging vehicle 1 can be operated and controlled from this control cabin 7.

Figure 2:
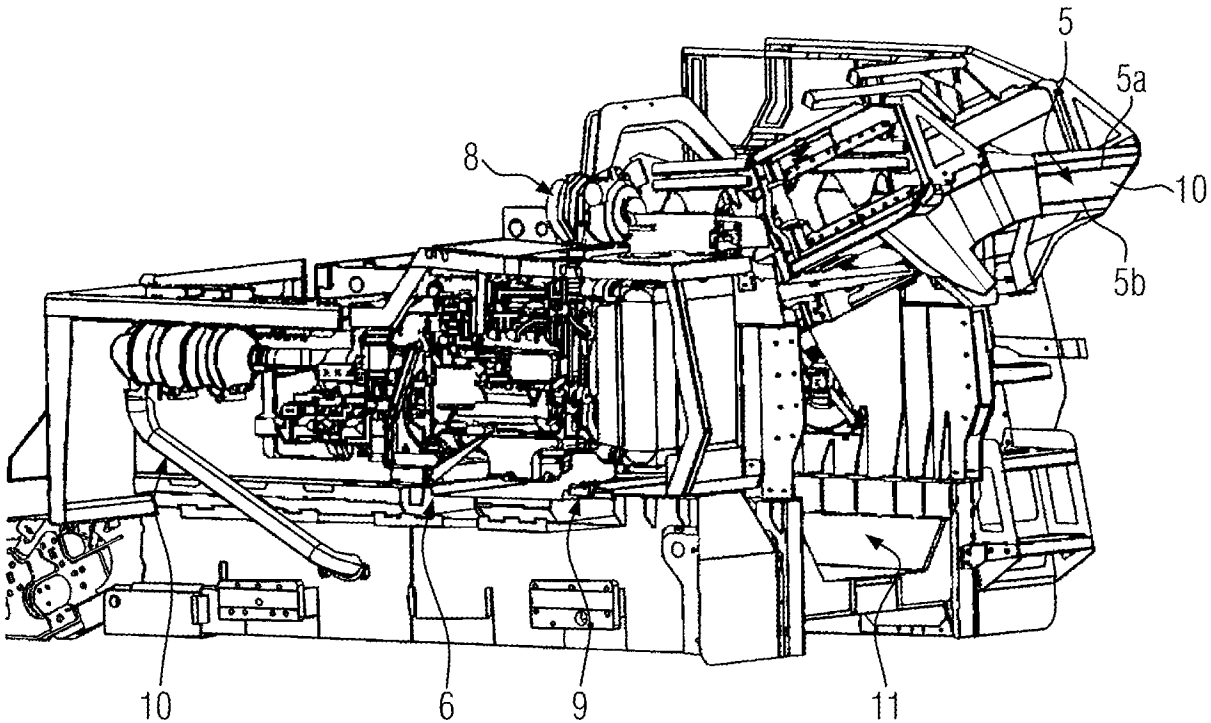
FIG. 2 a perspective view of the machine drive and the conveyor assembly of the charging vehicle.

FIG. 2 shows a perspective view of the conveyor assembly 5 and the machine drive 6 in the direction designated with II in FIG. 1. The conveyor assembly 5 designed as conveyor belt has an upper run 5*a* on which a road-surfacing mix is transported, and a lower run returning underneath the upper run 5*a*. FIG. 2 only shows a detail of the conveyor assembly 5 which actually extends much further to the right.

Combustion air for the machine drive 6 is sucked in at a suction point 8. A cooling system 9 for the machine drive 6 is located in the rear area of the machine drive 6.

At the outer side of the machine drive 6, seen in the driving direction, an exhaust pipe 10 is guided. Starting from the visible area, the exhaust pipe 10 extends to the conveyor assembly 5 to extend there in sections between the upper run 5*a* and the lower run 5*b* of the conveyor belt. In this manner, the upper run 5*a* and the road-surfacing mix located thereon are heated.

A storage space 11 is provided underneath the conveyor assembly 5. This is possible as the space underneath the conveyor assembly 5 is no longer occupied by the machine drive 6 as in conventional charging vehicles 1. The storage space 11 is, in the present embodiment, accessible from the rear side of the charging vehicle 1. Equipment, a water tank or spare parts can be stowed there, for example.

The charging vehicle 1 according to the invention becomes in particular advantageous by the machine drive 6 now being accessible from several sides. This considerably facilitates maintenance and cleaning operations and the installation of spare parts.

Starting from the represented embodiment, the charging vehicle according to the invention can be modified in many ways. For example, covers or sheeting can be provided to protect the machine drive 6.

The invention claimed is:

1. Charging vehicle for conveying a road-surfacing mix to a road finishing machine, wherein the charging vehicle comprises a conveyor assembly and a machine drive, wherein the machine drive is disposed at the charging vehicle laterally offset with respect to the conveyor assembly and wherein the conveyor assembly comprises a conveyor belt, and a section of an exhaust pipe of the machine drive is guided between an upper run and a lower run of the conveyor belt.

2. Charging vehicle according to claim 1, wherein the machine drive is disposed laterally next to the conveyor assembly.

3. Charging vehicle according to claim 1, wherein the machine drive is accessible from several sides.

4. Charging vehicle according to claim 1, wherein the bottom side of the conveyor assembly is accessible for maintenance and/or cleaning operations.

5. Charging vehicle according to claim 1, wherein a storage space is provided underneath the conveyor assembly.

6. Charging vehicle according to claim 1, wherein the exhaust pipe of the machine drive is guided at least in sections along the conveyor assembly.

7. Charging vehicle according to claim 1, wherein the conveyor assembly is disposed eccentrically on the charging vehicle.

* * * * *